US005421313A

United States Patent [19]

Strayer

[11] Patent Number: 5,421,313

[45] Date of Patent: Jun. 6, 1995

[54] COMPACTABLE BALL TOSSING APPARATUS

[75] Inventor: John D. Strayer, Bonita, Calif.

[73] Assignee: Richmond Engineering, Inc., Sausalito, Calif.

[21] Appl. No.: 52,692

[22] Filed: Apr. 27, 1993

[51] Int. Cl.[6] ..... A63B 69/00

[52] U.S. Cl. ..... 124/1; 124/50; 124/49; 273/26 D

[58] Field of Search ..... 273/26 D, 26 R, 29 A; 403/104, 83, 84, 91, 92, 93, 376–381; 124/1, 45, 47, 49, 50, 51.1, 53; 5/201

[56] References Cited

U.S. PATENT DOCUMENTS

| | | | |
|---|---|---|---|
| 2,955,823 | 10/1960 | Chanko . | |
| 2,955,824 | 10/1960 | Chanko . | |
| 3,999,753 | 12/1976 | Desilets | 273/29 A |
| 4,132,214 | 1/1979 | Schnurr . | |
| 4,220,331 | 9/1980 | Smith . | |
| 4,225,265 | 9/1980 | Hooker | 5/201 |
| 4,538,810 | 9/1985 | Brophy . | |
| 4,548,407 | 10/1985 | Sato . | |
| 4,676,504 | 6/1987 | Ponza . | |
| 4,860,717 | 8/1989 | Powell | 273/26 D |
| 4,905,946 | 3/1990 | Wang | 403/92 |
| 4,955,606 | 9/1990 | Leps . | |
| 5,042,802 | 8/1991 | Depianta | 273/26 D |
| 5,232,218 | 8/1993 | Leps | 273/26 D |

FOREIGN PATENT DOCUMENTS

| | | | |
|---|---|---|---|
| 1220057 | 1/1971 | United Kingdom | 273/29 A |

OTHER PUBLICATIONS

Sports Plus, Sausalito, California, undated four page sales brochure entitled: "Tom Leps SLO-TOSS".

*Primary Examiner*—Eric K. Nicholson
*Assistant Examiner*—Anthony Knight
*Attorney, Agent, or Firm*—Harris Zimmerman

[57] ABSTRACT

Practice batting of baseballs or the like is facilitated by apparatus having a gently inclined ball feeding trough from which balls drop onto a more steeply inclined ball acceleration chute. The chute has an upcurving lower end that directs the balls into a trajectory that initially extends upward and outward from the device. The lower end of the trough extends into a trough support at the upper end of the chute and is maintained in the operating position by pins on the trough or trough support which extend into slots on the other of the two components. The slot configuration enables pivoting of the trough towards the chute after a short longitudinal movement of the trough. This enables shipping, carrying and storage of the device in a much more compact form. Such compaction and set up of the apparatus prior to use does not require removal and reinstallation of threaded bolts, screws or the like.

11 Claims, 3 Drawing Sheets

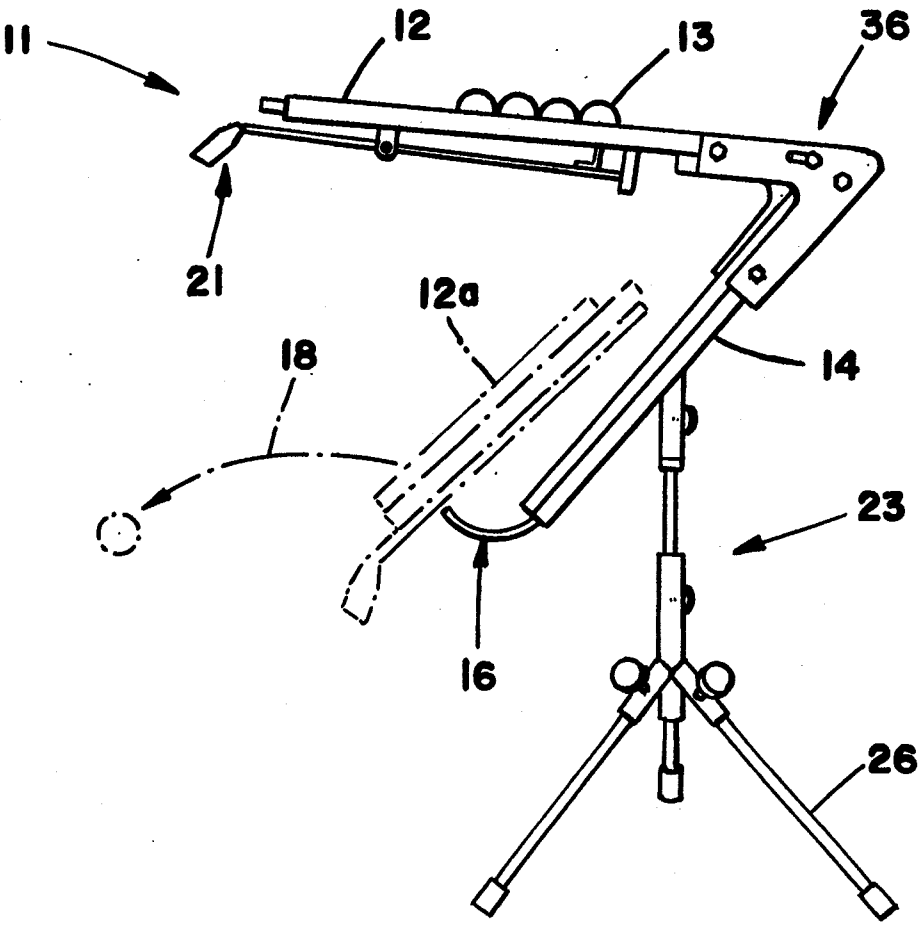
FIG_1
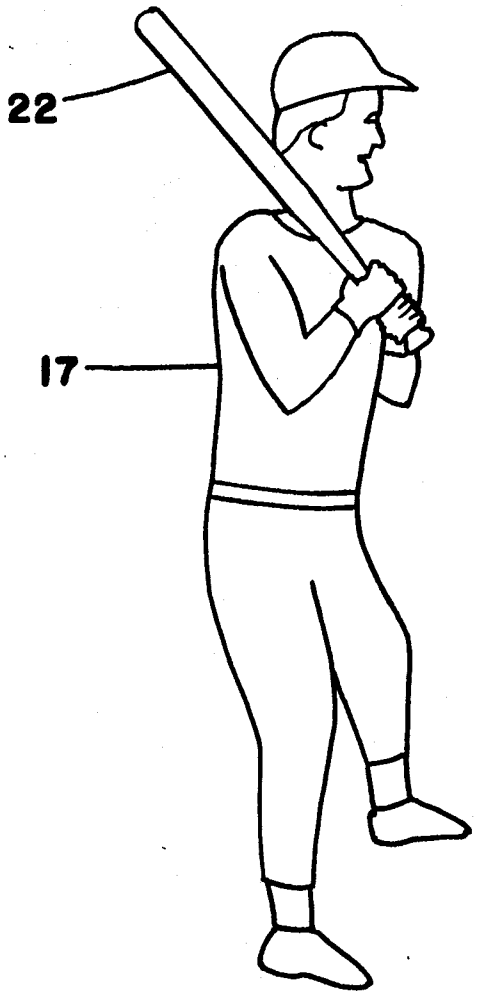

COMPACTABLE BALL TOSSING APPARATUS

TECHNICAL FIELD

This invention relates to athletic equipment and more particularly to apparatus for tossing balls during baseball batting practice or the practice of other sports which involve the striking of a ball.

BACKGROUND OF THE INVENTION

Practicing of the batting of baseballs or the like can be greatly facilitated by making use of tossing apparatus which simulates a human pitcher by repetitively directing balls towards the batter.

An advantageous known type of such apparatus has a gently inclined ball feeding trough in which a series of balls are placed and ball dispensing mechanism which may be tapped with the tip of a baseball bat or the like to initiate release of a ball. The lower end of the trough, from which the balls drop, extends into a trough support which is secured to the top of a steeply inclined ball acceleration chute. The lower end of the chute curves upwardly to direct the balls into a trajectory which initially extends upward and outward from the end of the chute. The chute is supported by a stand, typically of the tripod form, which has means for enabling adjustment of the height of the lower end of the chute to accommodate to batters of different sizes.

In ball tossers of the above described type, the lengthy ball feeding trough and lengthy ball acceleration chute have opposite inclinations and extend from the trough support at different angles. The assembled support tripod extends in still other directions. Thus, the assembled device is expansive in both the horizontal and vertical directions and exhibits prominent differently directed structural projections. Consequently, manufacturers package and ship the devices in a partially unassembled condition and retailers sell the devices in that condition. Final assembly is typically left to the purchaser.

In addition to assembly of the support tripod, the purchaser has been required to fasten one end of the ball feeding trough to the trough support with a series of thumbscrews, bolts or the like.

It would be advantageous to simplify the assembly process. While the need to perform an initial assembly might be considered to be a minor inconvenience, in practice the user of the device often finds it necessary to disassemble and reassemble the apparatus repetitively in some cases with each usage. The user may need to carry the device out of a home or other building prior to use and then return it after use. Often the user wishes to transport the device to a playing field or other distant open area. The device, in its assembled form, is heavy and cumbersome to carry and cannot easily be transported in many automotive vehicles. Finding storage space for the expansive assembly can also be a problem. The thumbscrews, bolts or the like that have heretofore been used to fasten the ball feeding trough to its support are small objects that can easily be overlooked or lost.

The present invention is directed to overcoming one or more of the problems discussed above.

SUMMARY OF THE INVENTION

In one aspect, the present invention provides apparatus for tossing balls to a batter which apparatus has a ball feeding trough with a first end region from which balls may drop and an inclined ball acceleration chute having an upper end positioned to receive the balls and an upcurving lower end for guiding the balls into a trajectory which initially extends upward and outward from the lower end of the chute. A trough support is fastened to the acceleration chute and is adapted to receive and support the trough. The trough and trough support have means for enabling longitudinal movement of the trough between first and second positions and means for maintaining the trough at a fixed angular orientation relative to the chute when the trough is at the first position and for enabling angular repositioning of the trough relative to the chute after the trough has been shifted longitudinally to the second position.

In another aspect of the invention, apparatus for tossing balls to a baseball batter or the like includes an inclined ball acceleration chute having an upper end for receiving balls and a lower end which curves upward to direct balls upward and outward from the lower end. A support stand has a telescoping vertical post which extends down from the chute and a plurality of legs extend downward and outward from the post, the support stand further having means for selectively separating the post from the chute and for selectively separating the legs from the post. An inclined ball feeding trough has a first pair of spaced apart side walls and a lower end region located above the chute in position to drop balls into the upper end of the chute, the inclination of the trough being opposite from the inclination of the chute. A trough support is secured to the upper end of the chute and has a second pair of side walls which extend along opposite sides of the lower end region of the trough. One of the pairs of side walls have a first pair of parallel slots which extend longitudinally along the trough and the other of the pairs of side walls has a first pair of transversely projecting pins which are aligned with each other and which extend into the first pair of slots at opposite sides of the trough. One of the pairs of side walls has a second pair of slots which are spaced apart from the first pair of slots and which extend in a vertical direction to intersect edges of the side walls. The other of the pairs of side walls has a second pair of transversely projecting pins which extend into the second pair of slots at opposite sides of the trough. Downward pivoting of the trough about the first pair of pins may be prevented by seating the second pair of pins in the second slots and may be enabled by pivoting the trough upward and then drawing the trough outward relative to the trough support.

The invention provides ball tossing apparatus which can quickly and easily be switched between the expansive operating configuration and a much more compact shape. Fastening and unfastening of screws, bolts or the like is unnecessary. Simple manipulations of the ball feeding trough enable the trough to be unlatched and pivoted downward into proximity with the lower end of the ball acceleration chute. Reversed manipulations restore the device to the operating configuration. This capability greatly facilitates carrying, transporting and storage of devices of this kind.

The invention, together with further aspects and advantages thereof, may be further understood by reference to the following description of the preferred embodiments and by reference to the accompanying drawings.

BRIEF DESCRIPTION OF THE DRAWINGS

FIG. 1 is a perspective view of ball tossing apparatus embodying the invention as it appears during use.

DETAILED DESCRIPTION OF THE PREFERRED EMBODIMENTS

Figure 2:
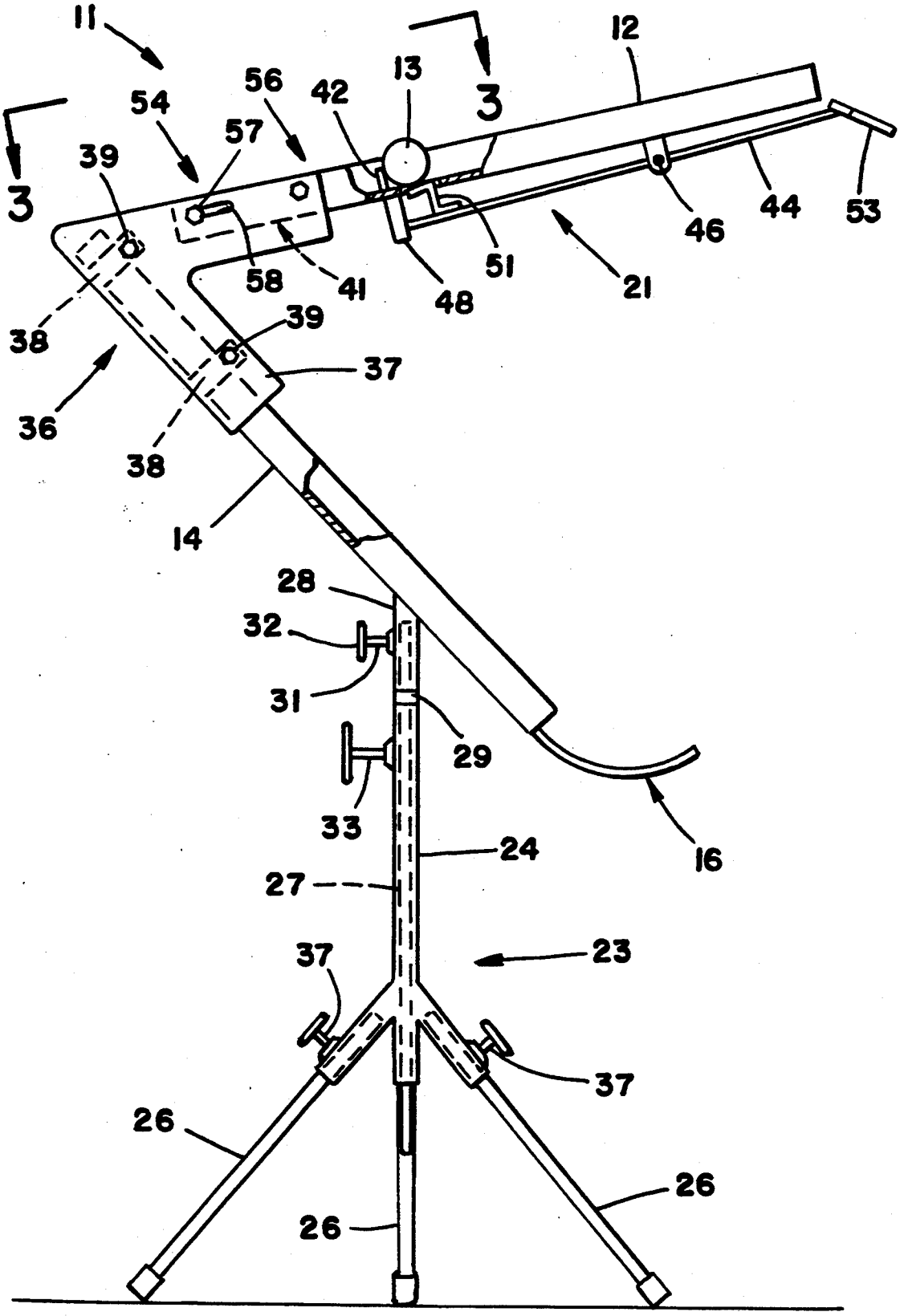
FIG. 2 is broken out side elevation view of the ball tossing apparatus of FIG. 1.

Referring initially to FIG. 1 of the drawings, ball tossing apparatus 11 in accordance with this embodiment of the invention has a gently inclined ball feeding trough 12 from which balls 13 drop into the upper end of a more steeply inclined ball acceleration chute 14 that slants in an opposite direction. The lower end 16 of the chute 14 curves upward and outward to direct the balls towards the batter 17 along a trajectory 18 that initially extends upward and outward from the lower end of the chute. Trajectory 18 carries the balls 13 to a location near the batter 17 at which the balls can be batted without striking the tossing apparatus 11 in the process. Ball dispensing mechanism 21, which will hereinafter be further described, can be tapped with the tip of the bat 22 to initiate release of a ball. A broad net (not shown) may be positioned a short distance away from the batter 19 to intercept batted balls although this is not essential to use of the ball tosser 11.

Figure 3:
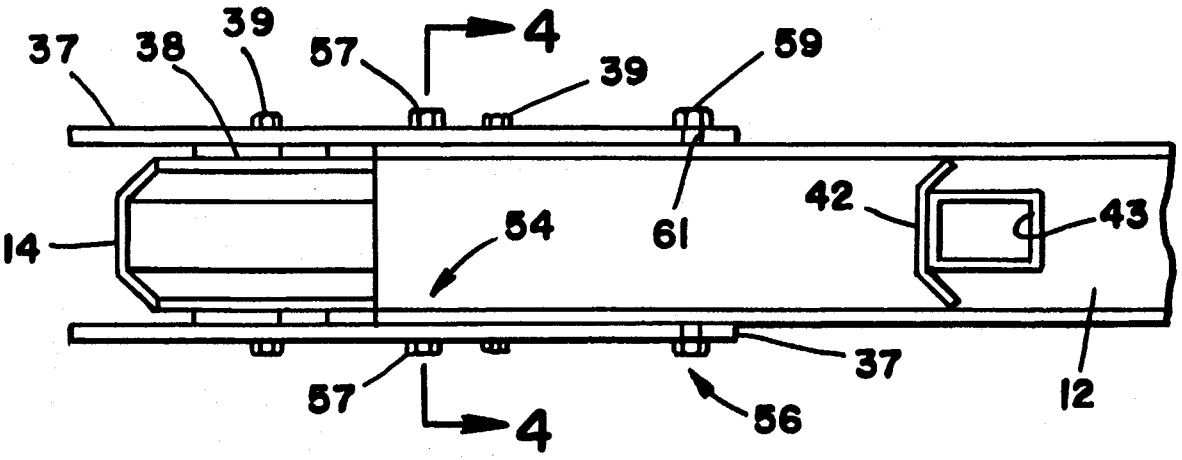
FIG. 3 is a view of a portion of the top region of the ball tossing apparatus taken along line 3—3 of FIG. 2.

Considering the construction of the apparatus 11 in more detail, with reference jointly to FIGS. 2 and 3, the ball acceleration chute 14 is secured to the top of a support stand 23 in a manner which enables selective separation of the two components. In this example, stand 23 has a tubular vertical post 24 supported by three tripod legs 26 which extend outward and downward from the base of the post. A rod 27 extends axially within post 24 and up into a short tubular member 28 which extends down from the underside of chute 14 and which is secured to the chute by welding or other means. Rod 27 has a flange 29 which seats against the lower end of member 28.

A first set screw 31, having a transverse handle 32, protrudes from the side of member 28 and may be tightened to clamp the member to rod 27 or be loosened to enable separation of the chute 14 and support stand 23. A second similar, but preferably larger, set screw 33 protrudes from the side of post 24 and is tightened to clamp the rod 24 to the post. Screw 33 may be temporarily loosened to enable axial movement of rod 27 relative to post 24 in order to raise the chute 14 a selected distance to accommodate to batters of different physical size.

Legs 26 are also preferably clamped in place by set screws 34 at the base of post 24 to enable separation of the legs from the post in the course of disassembly of the apparatus 11.

Chute 14 is a linear channel member which has sloping side walls in this embodiment except at the lower end 16 which may simply be a curving extension of the floor of the channel.

A trough support 36 is secured to the upper end of chute 14 and has a pair of spaced apart parallel flat side wall members 37 which are disposed at opposite sides of the chute. A pair of U-shaped brackets 38 situated between the side wall members 37 extend around the floor and sides of the chute 14 and are fastened to the members 37 by bolts 39, the bases of the brackets being welded to the floor of the chute. The lower end region 41 of ball feeding trough 12 is received between the trough support side members 37 at a location at which balls that drop from the end of the trough fall into the upper end of chute 14. The manner in which the trough 12 is engaged by the trough support 36 will hereinafter be described.

Figure 4:
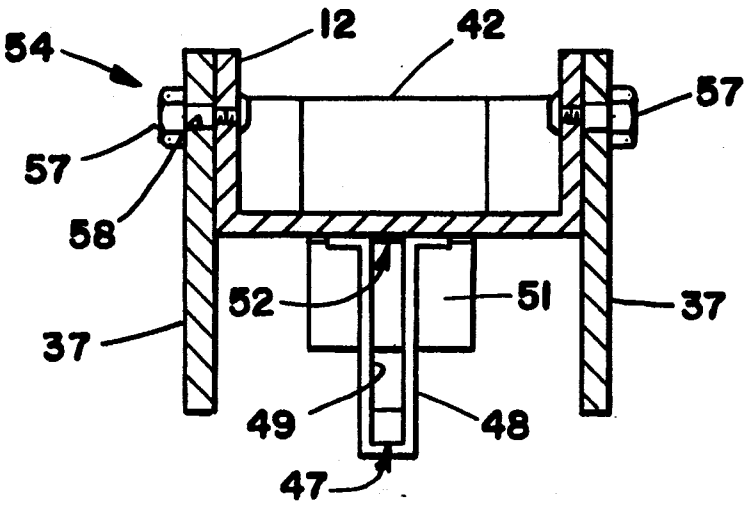
FIG. 4 is a cross section view of the top region of the ball tossing apparatus taken along line 4—4 of FIG. 3.

Balls 13 within the trough 12 are temporarily held in place by abutment against a stop member 42 which is situated near the lower end region 41 of the trough. As best seen in FIG. 3 in particular, the floor of trough 12 has an opening 43 situated immediately under the location of a ball that is abutted against stop member 42. Referring again to FIGS. 2 and 3 in conjunction, the ball dispensing mechanism 21 in this example of the invention includes a lever 44 extending along the underside of the trough 12 from the upper end of the trough to a location which is below opening 43. Lever 44 is coupled to trough 12 through a pivot 46 which enables upward and downward pivoting of the ends of the lever. Referring jointly to FIGS. 2 and 4, the lower end 47 of lever 44 extends into a guide 48 which forms a vertical slot 49 that accommodates to pivoting of the lever. A ball lifter member 51 which is secured to lever 44 extends up into opening 43 and forms a platform 52 on which the ball 13 rests when it is abutted against stop member 42. Platform 52 preferably has a slightly greater slope than the floor of trough 12. Pivoting of lever 44 raises ball 13 enabling it to override stop member 42 and roll into the acceleration chute 14. An inclined plate 53 at the upper end of lever 44 may be tapped with the baseball bat to pivot the lever and thereby initiate tossing of a ball.

Referring jointly to FIGS. 2, 3 and 4, the lower end region 41 of trough 12 engages with the trough support 36 through means 54 which enables longitudinal movement of the trough between a first and a second position and through means 56 for maintaining the trough at a fixed angular orientation relative to chute 14 when the trough is at the first position and which enables angular repositioning of the trough relative to the chute after the trough is shifted longitudinally to the second position.

In the preferred embodiment, means 54 includes a first pair of projecting pins 57 which are aligned with each other and which extend from opposite sides of the end region 41 of trough 12. Pins 57 extend into a first pair of slots 58 in the trough support side members 37 which slots extend longitudinally along the trough 12. Pins 57 are preferably threaded bolts that engage in the side walls of trough 12 as that enables separation of the trough from the trough support 36 if that is desired.

Means 56 in this embodiment includes a second pair of projecting pins 59 which also extend from opposite sides of the end region 41 of trough 12 and which are spaced apart from the first pair of pins 57. Pins 59 extend into a second pair of slots 61 in trough support side members 37. The second pair of slots 61 extend in a generally vertical direction and intersect the upper edges of the side walls 62 of trough 12.

During operation of the apparatus 11, the second pins 59 seat against the bottoms of the second slots 61 and thereby prevent the trough 12 from pivoting downward about the axis of the first pins 57. The first pins 57 cannot move upward and this prevents downward pivoting of trough 12 about the axis of second pins 59. Thus the trough 12 is maintained in the operating orientation.

Figure 5:
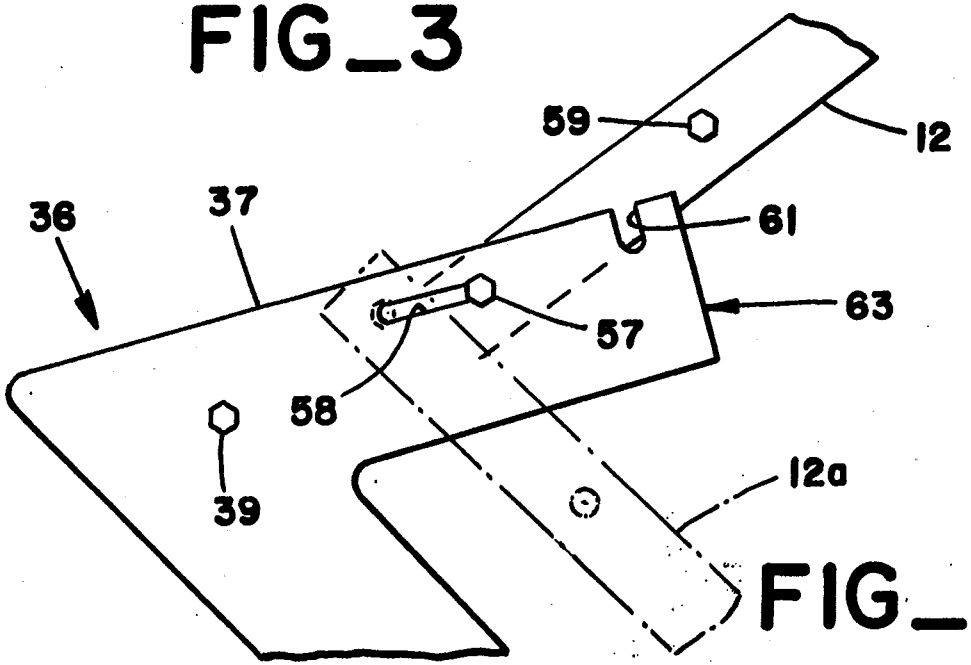
FIG. 5 is a side elevation view depicting successive stages in the conversion of the ball tossing apparatus from the expansive operating configuration into a more compact shape.

Referring now to FIG. 5, the apparatus 11 can be made more compact when it is not in use by a simple manipulation of trough 12. The trough 12 is pivoted upward about the axis of first pins 57 to lift the second pins 59 out of their slots 61. The trough 12 is then drawn outward relative to trough support 36 to travel the first pins 57 to the opposite ends of their slots 58. The trough 12 may then be pivoted downward towards chute 14 as depicted by dashed lines 12*a* in FIGS. 1 and 5. Reversing the above described manipulations of the trough 12 restores the apparatus 11 to the operating configuration.

Trough 12 extends out from the trough support 36 between edge regions 63 of trough support side members 37. To enable the above described repositioning of the trough 12, first slots 58 should have a length at least equal to the spacing of second pins 59 from edges 63.

Referring again to FIG. 2, the apparatus 11 may be further compacted when necessary by loosening set screw 31 and separating the stand 23 from the other components. The stand 23 may itself be compacted by loosening set screws 37 and separating legs 26 from post 24. When compacted in this manner, the components of the apparatus 11 can be placed a handled carrier bag or the like of a size that is practical to carry, manually or in an automobile.

The second slots 61 and second pins 59 are further from the top of chute 14 than the first slots 58 and pins 57 in this embodiment as this enables a maximum degree of compaction. Sizable compaction can still be effected if the locations of the first and second slots 58 and 61 and the first and second pins 57 and 59 are reversed.

Referring again to FIGS. 2 and 3, slots 58 and 61 of this embodiment are formed in the trough support side members 37 and pins 57 and 59 are fastened to trough 12. Alternately, the slots 58 and 61 may be formed in trough 12 and pins 57 and 59 may fasten to the side members 37 and extend in the direction of trough 12 although in this arrangement the second slots 61 should extend downward and intersect the base of trough 12 rather than extending upward to the top of the trough as in this embodiment.

Figure 6:
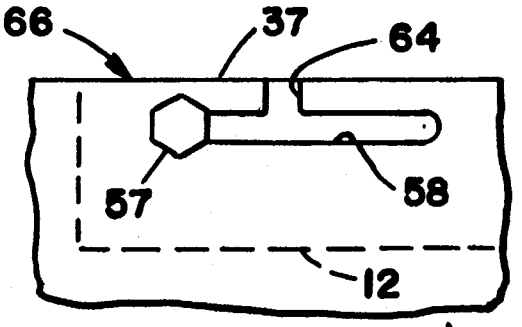
FIG. 6 is a side elevation view of a portion of the apparatus showing a modification which enables easy separation of the ball feeding trough from the other components as an alternative to pivoting of the trough.

FIG. 6 depicts a modification which differs from the above described embodiment only in that a third pair of slots 64 extend down from the upper edges 66 of trough support side members 37 and intersect the first slots 58 at locations which are away from the lower ends of the first slots. This enables easy detachment of the trough 12 from the trough support 36 as an alternative to simply pivoting the trough downward.

While the invention has been described with reference to certain preferred embodiments for purposes of example, many modifications and variations of the construction are possible and it is not intended to limit the invention except as defined in the following claims.

I claim:

1. Apparatus for tossing balls to a batter, said apparatus having a ball feeding trough with a first end region from which balls may drop, an inclined ball acceleration chute which has an upper end positioned to receive balls which drop from said feeding trough and which has an upcurving lower end for guiding said balls into a trajectory which initially extends upward and outward from said lower end, and a trough support fastened to said upper end of said acceleration chute and being adapted to receive and support said trough at said first end region thereof, wherein the improvement comprises:

said trough and trough support having engagement means for coupling said trough to said trough support which means enables longitudinal movement of said trough between a first position and a second position while said trough remains coupled to said trough support including at each of said first and second positions of said trough, and means for preventing downward pivoting of said trough towards said chute when said trough is at said first position and which enables downward pivoting of said trough towards said chute only after said trough is shifted longitudinally into said second position.

2. The apparatus of claim 1 wherein said trough has spaced apart side walls and said trough support has spaced apart side members between which said first end region of said trough is received, one of said trough and said trough support having a first pair of parallel slots situated at opposite sides thereof and which extend in the direction of said longitudinal movement of said trough and the other of said trough and said trough support having a first pair of aligned pins situated at opposite sides thereof and which extend into said first pair of slots wherein one of said trough and said trough support has a second pair of parallel slots which extend in a direction which is orthogonal to said direction of longitudinal movement of said trough and wherein the other of said trough and said trough support has a second pair of pins which extend into said second pair of slots, said first and second pairs of pins being at spaced apart locations along said trough.

3. The apparatus of claim 2 wherein said second pair of slots and second pair of pins are situated further from said upper end of said chute than said first pair of slots and pins.

4. The apparatus of claim 2 wherein said side members of said trough support terminate at edges thereof from which said trough extends and wherein each of said slots of said first pair thereof has a length at least as long as the spacing of said second pair of pins from said trough support edges when said trough is at said first position thereof.

5. The apparatus of claim 2 wherein said one of said trough and said trough support has a third pair of slots which intersect said first pair of slots and which extend upward therefrom to the upper edges of said one of said trough and trough support whereby said trough can be separated from said trough support by traveling said first pair of pins along said third pair of slots.

6. The apparatus of claim 2 wherein said first pair of pins are bolts having threaded engagements with said other of said trough and trough support.

7. The apparatus of claim 1 wherein said trough has spaced apart side walls and said trough support has spaced apart side members between which said first end region of said trough is received, wherein said trough support has a pair of longitudinally extending first slots in said side members which first slots extend along said first end region of said trough and a second pair of slots in said side members which extend downward into said side members, said second pair of slots being further away from said upper end of said chute than said first pair of slots, further including a pair of aligned pivot pins extending outward from opposite side walls of said trough and into said first pair of slots and a pair of aligned support pins extending outward from said opposite side walls of said trough and into said second pair of slots.

8. The apparatus of claim 7 wherein said trough extends out of said trough support and wherein said first slots have a length at least equal to the spacing of said second slots from the location at which said trough extends out of said trough support.

9. Apparatus for tossing balls to a baseball batter or the like, comprising:

an inclined ball acceleration chute having an upper end for receiving balls and a lower end which curves upward to direct balls upward and outward from said lower end;

a support stand having a telescoping vertical post which extends downward from said chute and having a plurality of legs which extend downward and outward from said post, said support stand further having means for selectively separating said post from said chute and for selectively separating said legs from said post;

an inclined ball feeding trough having a first pair of spaced apart side walls which have first upper edges and first lower edges and having a lower end region located above said chute in position to drop balls into said upper end of said chute, the inclination of said trough being opposite from the inclination of said chute;

a trough support secured to said upper end of said chute and having a second pair of spaced apart side walls which have second upper edges and second lower edges and which extend along said lower end region of said trough at opposite sides thereof;

one of said pairs of side walls having a first pair of parallel slots which extend longitudinally along said trough and the other of said pair of side walls having a first pair of transversely projecting pins which are aligned with each other and which extend into said first pair of slots at opposite sides of said trough;

one of said pairs of side walls having a second pair of slots which are spaced apart from said lower edges thereof and which are spaced apart from said first pair of slots and which extend in a vertical direction and intersect the upper edges of the side walls and the other of said pairs of side walls having a second pair of transversely projecting pins which extend into said second pair of slots at opposite sides of said trough;

whereby downward pivoting of said trough about said first pair of pins may be prevented by seating of said second pair of pins in said second slots and may be enabled by pivoting said trough upward and then drawing said trough outwardly relative to said trough support.

10. The apparatus of claim 9 wherein said second pair of slots and said second pair of pins are situated further from said upper end of said chute than said first pair of slots and said first pair of pins.

11. The apparatus of claim 10 wherein said trough side walls have end edges which are adjacent said trough support and at opposite sides thereof and wherein said slots of said first pair thereof each have a length at least equal to the spacing of said end edges from said second pair of pins.

* * * * *